United States Patent [19]

Walker et al.

[11] 4,027,489

[45] June 7, 1977

[54] MINE ROOF SUPPORT

[75] Inventors: John Hirst Walker, Winchcombe; James Anthony Sutton, Stoke Orchard; John Henry Waters, Up Hatherley, all of England

[73] Assignee: Dowty Mining Equipment Limited, Tewkesbury, England

[22] Filed: Apr. 12, 1976

[21] Appl. No.: 675,804

[30] Foreign Application Priority Data

Apr. 17, 1975 United Kingdom ..... 15798/75

[52] U.S. Cl. ..... 61/45 D

[51] Int. Cl.[2] ..... E21D 15/44

[58] Field of Search ..... 61/45 D; 299/31–33; 248/357; 91/170 MP

[56] References Cited

UNITED STATES PATENTS

| | | | |
|---|---|---|---|
| 3,921,409 | 11/1975 | Blumenthal | 61/45 D |

FOREIGN PATENTS OR APPLICATIONS

| | | | |
|---|---|---|---|
| 1,482,298 | 4/1967 | France | 61/45 D |
| 1,958,322 | 11/1970 | Germany | 61/45 D |
| 2,128,023 | 12/1972 | Germany | 61/45 D |
| 1,061,071 | 8/1967 | United Kingdom | 61/45 D |
| 156,132 | 1964 | U.S.S.R. | 61/45 D |

*Primary Examiner*—Dennis L. Taylor
*Attorney, Agent, or Firm*—Young & Thompson

[57] ABSTRACT

A mine roof support comprising a roof engaging canopy, a floor-engaging means, a pair of shields pivotally secured to the canopy and extending downwardly and rearwardly in side-by-side relation over the floor-engaging means, a quadrilateral linkage securing each shield to the floor-engaging means and extensible strut means for adjusting the height of the canopy so arranged that the canopy may tilt about a transverse horizontal axis and a fore and aft axis to engage the roof, the shields being capable of providing differing height settings to accommodate canopy tilt about the fore and aft axis.

10 Claims, 6 Drawing Figures

MINE ROOF SUPPORT

This invention relates to a mine roof support intended for use in conjunction with a number of similar supports arranged in a line along the mineral face in a mine, the support including a shield device arranged between floor and roof to retain the debris which falls from the roof and to prevent it from entering the working space provided by the support adjacent to the mineral face. Such working space will accommodate mining apparatus such as a mineral cutting machine and a mineral conveyor.

In accordance with the present invention a mine roof support comprises:

i a floor engaging means. ii a roof engageable means above the floor engaging means and adjustable heightwise with respect thereto, and:

iii an inter-connection between the floor engaging means and the roof engageable means, iv the inter-connection including two shields in side-by-side relationship, a part of each shield being pivotally associated with the roof engageable means and being capable of movement in a heightwise direction relative to the corresponding part of the other shield.

The roof engageable means may comprise a single member tiltable about a fore and aft axis by virtue of the differing height settings between the shield parts.

The inter-connection may include one or more extensible prop members acting between the floor engaging means and the roof engageable means. Alternatively the inter-connection may include one or more extensible prop members acting between the floor engaging means and the shield.

Spring means may be provided to urge the shields into their side-by-side relation in which the said shield parts have the same height setting.

The shields may be supported on the floor engaging means by pivot connections. The pivot connection for each shield may comprise an upper link and a lower link pivotally engaging the lower end portion of the shield at spaced positions and also pivotally engaging the floor engaging means at spaced positions.

The said spring means may include a first spring acting between the two upper links to hold them in spaced parallel relation.

The floor engaging means may include two spaced parallel beams extending in the fore and aft direction, and a second spring may act between the beams to tend to retain them in their spaced parallel relation.

A connector may be secured between the shields to limit the relative movement between the shields.

One embodiment of the invention will now be described, by way of example, with reference to the accompanying drawings in which.

Figure 1:
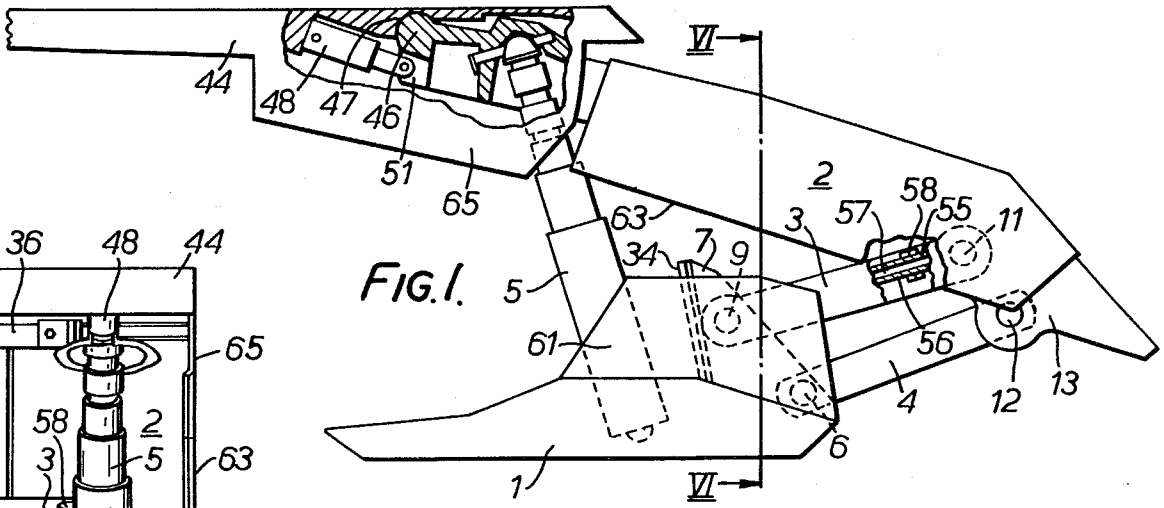
FIG. 1 is a side elevation of a support.

The illustrated roof support comprises two similar sub-frames arranged in side-by-side relation. One sub-frame comprises a floor beam 1, a shield member 2, a first link 3, a second link 4 and an extensible prop 5. The link 4 is pivotally mounted by a pin 6 extending through suitable holes in upstanding flanges 7 formed at the rear end portion of the floor beam 1. The link 3 is similarly carried by a pivot pin 9 also extending between suitable holes in the flanges 7. At their opposite ends the links 3 and 4 are supported by spaced pivot pins 11 and 12 which pass through suitable holes in spaced flanges 13 extending from the interior surface of the shield 2.

The second sub-frame comprises a floor beam 21, a shield member 22, a first link 23, a second link 24 and an extensible prop 25. The first and second links of the second frame are pivotally mounted between upstanding flanges 27 located at the rear end portion of the floor beam 21 by means of pivot pins 26 and 29 which extend through the flanges 27 at spaced positions. The other ends of the links 23 and 24 are carried by pivot pins 31 and 32 extending through flanges 33 formed on the interior surface of the shield member 22.

Figure 3:
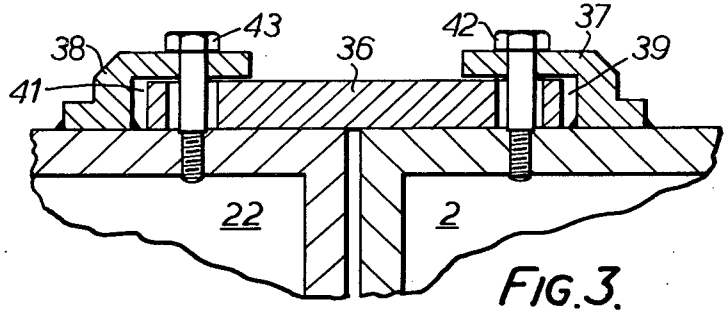
FIG. 3 is a detailed cross-section showing to an enlarged scale a feature of the support appearing in FIG. 2.
Figure 2:
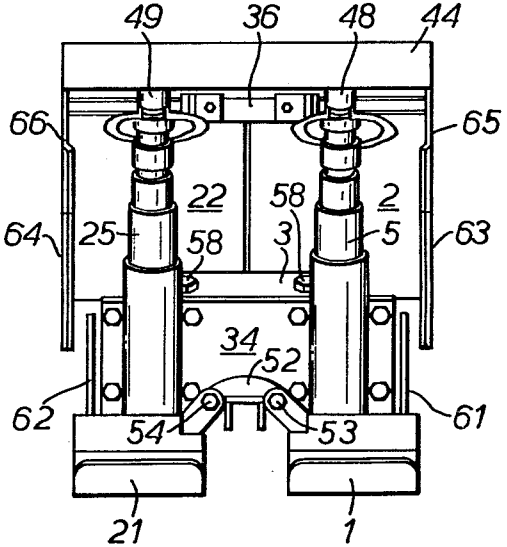
FIG. 2 is a front elevation of the roof support.
Figure 4:
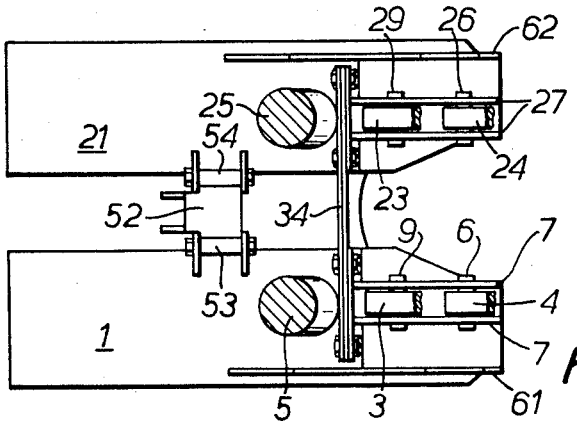
FIG. 4 is a plan view of the floor beams of the support, the roof beams and shield members having been removed.
Figure 5:
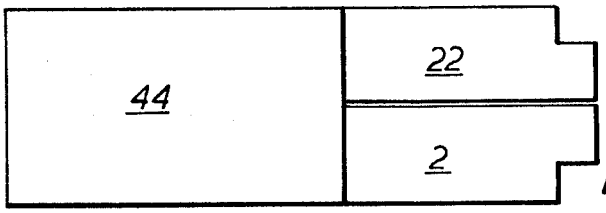
FIG. 5 is plan view of the support to a smaller scale.
Figure 6:
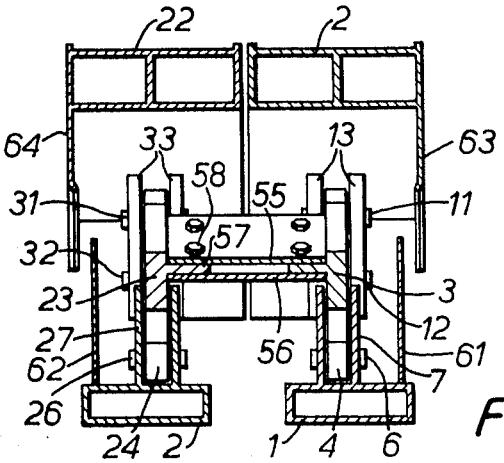
FIG. 6 is a cross-section taken on the line VI — VI of FIG. 1.

The two sub-frames are secured together in side-by-side relation, there being a number of connections between the sub-frames to hold them together and yet provide for some independent movement between similar parts of the sub-frames. These connections are as follows:

a. A flexible link 34 in the form of a spring metal plate secured by bolts across the front edges of the flanges 7 and 27.

b. A connector 36 secured across the upper front edges of the shields 2 and 22. The connector 36 is shown on a larger scale in FIG. 3 and will be seen to comprise a metal strip secured to each shield by brackets 37 and 38. Each of the brackets in conjunction with the end face of the associated shield provides a slot respectively 39 and 41 to receive the ends of the connector strip 36. To ensure that the connector strip is retained in position in the brackets, each bracket includes a bolt respectively 42 and 43 whose shank extends through a considerably larger hole in the connector 36. The function of the connector 36 is to prevent substantial relative movement between the two shields in a direction parallel to their length but to permit other relative movement.

c. A single roof beam 44 carried at the other end of the shields 2 and 22 by a pivotal connection on each shield. For the shield 2 the pivotal connection comprises a ball 46 extending from the upper end portion of the shield which fits into a socket 47 in the underside of the roof beam 44. A pin (not shown) may be provided acting between the ball 46 and the socket 47 to ensure that they do not move apart. For the shield 22 the pivotal connection is a ball (not shown) fitting into socket (not shown) in the underside of the roof beam 44, such ball and socket being substantially the same as 46, 47 for shield 2. For the purpose of adjusting the angular setting of the beam 44 relative to the shields 2 and 22 a pair of hydraulic rams 48 and 49 are provided adjacent the ball joints under the roof beam, such jacks reacting against connectors such as connector 51 on the shield 2. The jacks 48 and 49 adjust roof beam 44 about a common axis through the centres of the ball joints carried by the shields. The roof beam 44 is also tiltable about an axis at right angles to the said axis through the ball joints by virtue of independent height adjustments of the two shields 2 and 22.

d. A bridge member 52 secured by hinges 53 and 54 to the two floor beams 1 and 21. The hinge axes are parallel to the lengths of the floor beams and have a sufficient degree of looseness to enable the floor beams to move slightly relatively to one another about a horizontal axis in the plane of the spring plate 34.

e. A pair of flexible spring plates 55 and 56 secured between the upper links 3 and 23. For this purpose each of these upper links 2 and 23 is provided with an inwardly directed flange 57 and the spring plates are secured on either side of the flanges 57 by means of bolts 58. The spring plates may form an auxiliary shield against entry of debris under the lower ends of the shields.

For each of the sub-frames the first and second links and the pivotal connections between these links and the associated floor beam and shield member are so arranged that during angular movement of the shield above the floor beam the ball joint at the upper end of the shield is constrained to move in a substantially straight line in a direction perpendicular to the length of the floor beam, such movement, of course, being controlled by the extensible prop. The links and their pivotal joints restrain the shields from any movement other than angular movement in a plane defined by the fore and aft direction of the floor beam and the said substantially straight line. Since the floor beams are parallel, the shields are thus constrained to move in parallel planes. The extensible prop itself engages in its associated shield and floor beam by means of ball connections.

The hydraulic rams 48 and 49 which control the inclination of the roof beam may each include a pressure relief valve arranged in such a manner that downward load on the roof beam near to the forward end thereof cannot exert sufficient force to tip the whole support about the forward ends of the floor beam.

When the roof support as described is in use it will be arranged in side-by-side relation in a number of similar roof supports in, say, a coal mine adjacent to a coal face, the roof beams 44 extending forwardly from the floor beams 1 and 21 to protect a space adjacent to the coal face within which a flexible conveyor is located. This conveyor is of conventional form and for each support an advancing jack is provided which connects the support to the conveyor. This advancing jack is not shown in the drawings but it is accomodated in the space between the floor beams 1 and 21 and is connected to the bridge member 52. The advancing jack is capable of moving the whole support in this fore and aft direction. This advancing jack may take the form disclosed in our Application No: 514261.

Each of the floor beams at its outer rear end portion is provided with a side screen respectively 61 and 62. The outer edge of each shield also includes a downwardly extending side screen respectively 63 and 64. One of these side screens, e.g. side screen 63, may be mounted for adjustable movement to effect engagement with a side screen 64 of an adjacent support when in use. The roof beam 44 may also include a pair of downwardly extending side screens 65 and 66 arranged in end-to-end relation respectively with the side screens 63 and 64. Again one of these side screens, e.g. side screen 65 may be outwardly adjustable.

For operation a number of the supports as described are placed in a row in side-by-side relation along a coal face, the roof beam 44 of each support extending forwardly above the front edge of the floor beams and defining an open space within which a flexible conveyor is located for carrying coal cut from the coal face. Normally all of the props 5 and 25 will be supplied with hydraulic liquid at pressure so that each roof beam is urged upwardly against the roof. Each prop has its own yield valve so as to be independently yieldable under excessive load. In the conventional way the supports may be released one at a time from the roof in order to advance towards the conveyor as coal is excavated from the face, the hydraulic props then being reset after the advance movement has been completed. When a support is set the roof beam will engage the roof and almost certainly will tilt in order to provide the fullest possible engagement with the uneven surface of the roof. This tilting of the roof beam is accommodated by tilting of the roof beam about an axis parallel to the coal face which passes through both of the ball connections at the ends of the shields and also by tilting about a fore and aft axis perpendicular to the coal face which is accommodated by different height settings of the shields 2 and 22. Since the ball joints at the upper ends of the shields are constrained to move vertically, differing height settings of the shields will not cause the roof beam to move angularly about a vertical axis. The floor is also uneven and it is equally necessary for the floor beams, 1 and 21 to make the best possible contact with the floor. For this purpose the two floor beams 1 and 21 are connected by the spring plate 34 which in particular will allow relative angular movement between the floor beams about a horizontal axis lying in the plane of the plate 34, such relative movement being accommodated by twisting of the plate 34. The bridge member 52 secured by hinges 53 and 54 to the floor beams at a position spaced from the plate 34 will not prevent such angular movement since the hinges 53 and 54 have a sufficient degree of looseness. However, the bridge 52 will act to tend to maintain a constant spacing between the floor beams in that it will prevent relative angular movement between the floor beams about a vertical axis.

When the shields adjust themselves to slightly differing heights under the action of the hydraulic props 5 and 25 to accommodate roof beam tilt the spring plates 57 and 58 will twist as the links 3 and 23 tend to take up different angular positions.

Within the broad scope of the invention various modifications of the illustrated embodiment may be made as follows:

a. The floor beams 1 and 21 may be made as one unit having a central channel to receive the advancing jack. In this case the advantage of flexibility between the two floor beams would be lost but flexibility between the shields enabling tilting of the roof beam about a fore and aft axis would still be retained.

b. The prop, or props, may act directly between the floor beam or beams and the roof beam, the shield members at their upper ends then being supported at the roof beam.

c. The pivot mounting of each shield on the floor beam may be by virtue of a single pivot whereby the free end of each shield is constrained to move in a circular path lying in a plane parallel to the longitudinal axis of the floor beam, other relative movements between the shield and the floor beam being resisted by the pivot mounting.

d. Whilst in the illustrated embodiment the roof beam 44 is shown as a single member it can be made as two separate members arranged to be supported, one at the upper end of each shield by the ball joint 46, 47. The ball joints may be substituted by pin joints having a slight degree of looseness.

We claim:

1. A mine roof support comprising a floor engaging means, a roof engageable means above the floor engaging means, and interconnection between the floor engaging means and the roof engageable means, the interconnection including two shields in side-by-side relationship, a part of each shield being pivotally associated at the roof engageable means and being capable of movement in a heightwise direction relative to the corresponding part of the other shield, spring means for urging the shields into their side-by-side relation in which the said shield parts have the same height setting, and jack means adjustable in length to vary the height of the roof engageable means over the floor engaging means.

2. A mine roof support as claimed in claim 1, wherein the roof engageable means comprises a single member and including a universal joint mounting the single member on each shield whereby the single member is tiltable about a fore and aft axis by virtue of the differing height settings between the shields.

3. A mine roof support as claimed in claim 1, wherein the shields are supported on the floor engaging means by pivot connections.

4. A mine roof support as claimed in claim 2, wherein the shields are supported on the floor engaging means by pivot connections.

5. A mine roof support as claimed in claim 3, wherein the pivot connections for each shield comprise an upper link and a lower link pivotally engaging the lower end portion of the shield at spaced positions and also pivotaly engaging the floor engaging means at spaced positions.

6. A mine roof support as claimed in claim 4, wherein the pivot connection for each shield comprises an upper link and a lower link pivotally engaging the lower end portion of the shield at spaced positions and also pivotally engaging the floor engaging means at spaced positions.

7. A mine roof support comprising a floor engaging means, a roof engageable means above the floor engaging means, an interconnection between the floor engaging means and the roof engageable means comprising two shields in side by side relationship, a part of each shield being pivotally associated with the roof engageable means and being capable of movement in a heightwise direction relative to the corresponding part of the other shield, jack means adjustable in length to vary the height of the roof engageable means over the floor engaging means, spring means for urging the shields into their side by side relation, in which the shield parts have the same height setting and for each shield an upper link and a lower link pivotally engaging the lower end portion of the shield at spaced positions and also pivotally engaging the floor engaging means at spaced positions, the said spring means including a first spring acting in between the two upperlinks to hold them in spaced parallel relation.

8. A mine roof support as claimed in claim 7, wherein the roof engageable means comprises a single member and including a universal joint mounting the single member on each shield, whereby the single member is tiltable about a fore and aft axis by virtue of the differing height settings between the shield parts.

9. A mine roof support as claimed in claim 7, wherein the floor engaging means includes two spaced parallel beams extending in the fore and aft direction and the said spring means includes a second spring acting between the beams to tend to retain them in their spaced parallel relation.

10. A mine roof support as claimed in claim 8, wherein the floor engaging means includes two spaced parallel beams extending in the fore and aft direction, and the said spring means includes a second spring acting between the beams to tend to retain them in their spaced parallel relation.

* * * * *